US007077127B2

(12) United States Patent
Christianson

(10) Patent No.: US 7,077,127 B2
(45) Date of Patent: Jul. 18, 2006

(54) FLIP TOP VALVE FOR DRY SNORKELS

(76) Inventor: Tony Christianson, 2007 Wawona Station, Yosemite, CA (US) 95389

( * ) Notice: Subject to any disclaimer, the term of this patent is extended or adjusted under 35 U.S.C. 154(b) by 0 days.

(21) Appl. No.: 11/075,490

(22) Filed: Mar. 8, 2005

(65) Prior Publication Data

US 2005/0188986 A1 Sep. 1, 2005

Related U.S. Application Data

(63) Continuation of application No. 10/717,391, filed on Nov. 17, 2003, now Pat. No. 6,904,910.

(60) Provisional application No. 60/428,034, filed on Nov. 20, 2002.

(51) Int. Cl.
*B63C 11/16* (2006.01)
*B63C 11/02* (2006.01)

(52) U.S. Cl. ..... 128/201.11; 128/201.27

(58) Field of Classification Search ..... 128/200.29, 128/201.11, 201.26, 201.12, 201.27, 201.28, 128/201.29, 206.29; 405/186, 187; 181/21, 181/22

See application file for complete search history.

(56) References Cited

U.S. PATENT DOCUMENTS

| | | | | |
|---|---|---|---|---|
| 46,902 | A | | 3/1865 | Hawkins |
| 156,599 | A | | 11/1874 | Schmitz |
| 908,690 | A | | 1/1909 | Neubert |
| 1,946,126 | A | | 2/1934 | Black |
| 2,317,236 | A | | 11/1943 | Wilen et al. |
| 2,362,240 | A | | 11/1944 | Bonilla |
| 2,362,775 | A | | 11/1944 | Sebouh |
| 2,408,166 | A | | 9/1946 | Hawkins |
| 2,534,568 | A | | 12/1950 | Bedini et al. |
| 2,815,751 | A | * | 12/1957 | Ferraro ..... 137/410 |
| 2,931,057 | A | | 4/1960 | Vilarem |
| 3,140,551 | A | | 7/1964 | Wayfield |
| 3,141,469 | A | | 7/1964 | Stradella |
| 3,166,083 | A | * | 1/1965 | Girden ..... 137/388 |
| 3,345,984 | A | * | 10/1967 | Katehis ..... 128/201.11 |
| 3,603,306 | A | | 9/1971 | Bonin Jr. |
| 3,721,236 | A | | 3/1973 | Bardehle |
| 3,860,042 | A | | 1/1975 | Green |
| 4,071,024 | A | | 1/1978 | Blanc |
| 4,259,951 | A | | 4/1981 | Chernack et al. |
| 4,278,080 | A | | 7/1981 | Schuch |
| 4,610,246 | A | | 9/1986 | Delphia |
| 4,655,212 | A | | 4/1987 | Delphia |
| 4,708,135 | A | | 11/1987 | Arkema |
| 4,782,830 | A | | 11/1988 | Forman |
| 4,793,341 | A | | 12/1988 | Arasmith |
| 4,805,610 | A | | 2/1989 | Hunt |
| 4,834,084 | A | | 5/1989 | Walsh |
| 4,860,739 | A | | 8/1989 | Vandepol |
| 4,872,453 | A | | 10/1989 | Christianson |

(Continued)

*Primary Examiner*—Teena Mitchell
(74) *Attorney, Agent, or Firm*—Christie, Parker & Hale, LLP

(57) ABSTRACT

The instant invention is a valve for the top end of skin diving snorkels having a conduit with an open end above the water surface, and an underwater end that terminates in a mouthpiece. The mouthpiece provides a flow path between the conduit and the interior of the diver's mouth. The top valve consists of a soft diaphragm mounted on a compound linkage. The linkage is attached to the conduit adjacent the top opening. A float activates the valve linkage whenever the snorkel starts to descend below the water surface. By the time the open end of snorkel is underwater, the linkage has moved the diaphragm over and against the top opening thereby preventing water from entering the conduit.

26 Claims, 4 Drawing Sheets

U.S. PATENT DOCUMENTS 4,877,022 A 10/1989 Christianson
4,879,995 A 11/1989 Christianson
4,884,564 A 12/1989 Lamont
4,896,664 A 1/1990 Harayama
5,027,805 A 7/1991 Kung
5,092,324 A 3/1992 Christianson
5,101,818 A 4/1992 Chace et al.
5,117,817 A 6/1992 Lin
5,193,530 A 3/1993 Gamow et al.
5,199,422 A 4/1993 Rasocha
5,239,990 A 8/1993 Delphia
5,261,396 A 11/1993 Faulconer et al.
5,265,591 A 11/1993 Ferguson
5,267,556 A 12/1993 Feng
5,280,785 A 1/1994 Fujima
5,297,545 A 3/1994 Infante
5,351,681 A 10/1994 Hudson
5,404,872 A 4/1995 Choi
5,487,379 A 1/1996 Koshiishi
5,524,611 A * 6/1996 Fu ..... 128/201.11
5,529,057 A * 6/1996 Ferrero et al. ..... 128/201.11
5,535,734 A 7/1996 Lu et al.
5,622,165 A 4/1997 Huang
5,657,746 A 8/1997 Christianson
5,664,558 A 9/1997 Wagner
5,671,728 A 9/1997 Winefordner et al.
5,865,169 A 2/1999 Lan et al.
5,868,129 A 2/1999 Christianson
5,893,362 A 4/1999 Evans
5,906,199 A 5/1999 Budzinski
5,960,791 A * 10/1999 Winefordner et al. . 128/201.11
6,073,626 A 6/2000 Riffe
6,079,410 A 6/2000 Winefordner et al.
6,085,744 A 7/2000 Hermansen et al.
6,129,081 A 10/2000 Wu
6,276,362 B1 8/2001 Chen-Lieh
6,302,102 B1 * 10/2001 Giroux et al. ..... 128/201.11
6,318,363 B1 11/2001 Monnich
6,321,745 B1 11/2001 Christianson et al.
6,363,929 B1 4/2002 Winefordner et al.
6,371,108 B1 4/2002 Christianson
6,622,722 B1 * 9/2003 Chen-Lieh ..... 128/201.11
6,655,378 B1 * 12/2003 Swetish ..... 128/201.11
6,679,253 B1 * 1/2004 Feng ..... 128/201.11
6,904,910 B1 * 6/2005 Christianson ..... 128/201.11

* cited by examiner

FLIP TOP VALVE FOR DRY SNORKELS

CROSS-REFERENCE TO RELATED APPLICATIONS

The instant invention is a continuation application of U.S. Ser. No. 10/717,391 filed Nov. 17, 2003, issued as U.S. Pat. No. 6,904,910 on Jun. 14, 2005 and is related to Provisional Application No. 60/428,034 entitled "Flip Top Valve For Dry Snorkels," filed Nov. 20, 2002; and Disclosure Document No. 534,494 entitled "Flip Top Valve for Dry Snorkels," filed Jul. 10, 2003, the disclosure of which are incorporated herein by reference.

BACKGROUND OF THE INVENTION

1. Field of the Invention

The present invention is generally related to snorkels used by skin divers and swimmers. More particularly, this invention is concerned with preventing water from entering and flooding a snorkel.

2. Description of the Prior Art

Skin divers and swimmers use the snorkel as a means to breathe while swimming face down on the water surface. The snorkel functions as a conduit between the diver's mouth and the overhead air. Typically, the open end of the snorkel conduit extends a short distance above the water surface. Occasionally, due to swimming movements or wave action, small amounts of water flow or splash into the open end of the snorkel and partially floods the conduit. An experienced skin diver can sense when water enters the snorkel and responds by immediately stopping inhalation. Respiration is resumed after the snorkel has been purged of water. Inexperienced skin divers find occasional flooding especially troublesome because, undetected, water can be inhaled resulting in coughing and extreme discomfort.

Water will also flood the snorkel when the swimmer deliberately dives below the water surface. The snorkel conduit will be completely flooded with water when the swimmer returns to the surface. When the open end of the snorkel is again above the water surface, the flooded conduit is purged for respiration by exhaling an explosive blast of air into the mouthpiece.

Surface tension forms the purging blast of air into a bubble that spans the cross section of the snorkel conduit. Pressure within the bubble expands the bubble toward the open end of the conduit. As the leading surface of the bubble moves away from the mouthpiece, the bulk of the water within the conduit is pushed ahead of the bubble and out the open end.

The purging bubble of air will slip past water that adheres to the inside surface of the conduit. After the purging air bubble is spent, residual water will flow down the inside surface toward the mouthpiece. Also, water which splashes into the open end of the snorkel conduit due to swimming movements or wave action will typically strike and adhere to the inside surface of the conduit and thereafter flow toward the mouthpiece. Water accumulates at the lowermost portion of the snorkel conduit, typically adjacent the mouthpiece, and can soon obstruct the conduit. Unless the conduit is completely blocked, a slow and cautious inhalation is possible after which another purging exhalation can be made.

The respiratory effort needed to purge a snorkel is significant. Many skin divers and swimmers lack the respiratory strength needed to completely puree a flooded snorkel with a single exhalation, and must repeat the purging procedure several times. Also, water will sometimes enter the snorkel just as the swimmer has completed an exhalation, leaving very little air in the lungs to satisfactorily complete a purge.

As a consequence of the difficulties typically encountered by a skin diver or swimmer when trying to purge a flooded snorkel, a number of inventions have been proposed to protect the snorkel opening with devices that prevent water from entering the conduit, even when the swimmer dives underwater.

SUMMARY OF THE INVENTION

The instant invention is a valve for the top end of skin diving snorkels having a conduit with an open end above the water surface, and an underwater end that terminates in a mouthpiece. The mouthpiece provides a flow path between the conduit and the interior of the diver's mouth. The conduit's above water opening is in-line with the conduit's longitudinal axis, thereby providing a substantially straight and unrestricted respiratory flow path. The top valve consists of a flexible diaphragm mounted on a compound linkage. The linkage is attached to the conduit adjacent the top opening. A buoyant component activates the valve linkage whenever the snorkel starts to descend below the water surface. By the time the open end of snorkel is underwater, the linkage has moved the diaphragm over and against the top opening thereby preventing water from entering the conduit. Conversely, when the top of the snorkel is above the water surface, the diaphragm is moved to the side of the conduit, completely away from the top opening and out of the respiratory flow path.

BRIEF DESCRIPTION OF THE DRAWINGS

A detailed description of the invention is made with reference to the accompanying drawings wherein like numerals designate corresponding parts in the several Figures.

DETAILED DESCRIPTION OF THE INVENTION

Figure 1:
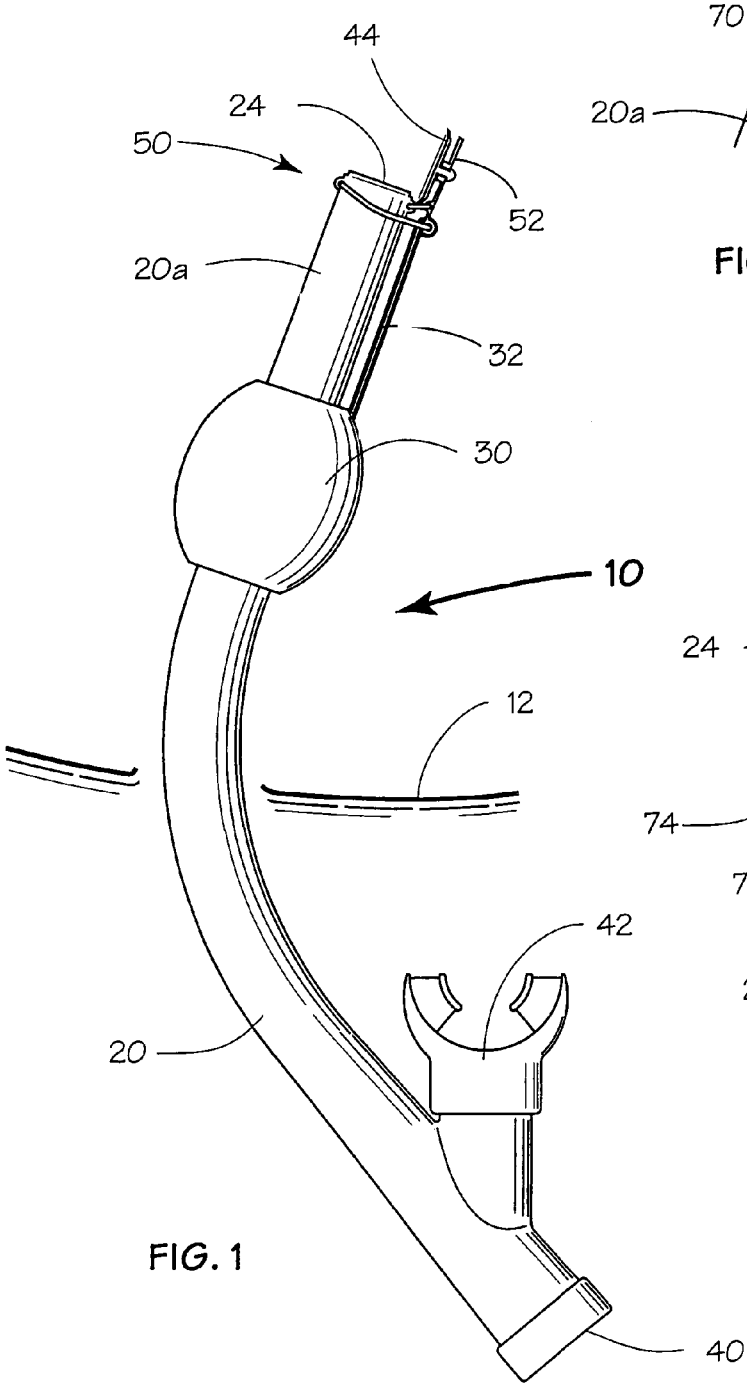
FIG. 1 is a side view of a snorkel having a top valve that has been constructed in accordance with the principles of the instant invention.

Referring to FIG. 1, a snorkel 10 in accordance with an embodiment of the invention is pictured in the approximate position of use by a diver swimming face down on water surface 12. (For clarity, the diver is not shown in the FIGS.)

The words "upper" and "lower" or "above the water surface" and "below the water surface," or the like, are made with reference to the orientation of snorkel 10 go shown in FIG. 1.

Snorkel 10 includes conduit 20 having upper end 20*a* that extend into the air above water surface 12. The lower end of conduit 20 is closed by purge valve 40. Purge valve 40 is arranged to allow fluid, for example water or saliva, to flow freely from conduit 20 to ambient. Although the preferred configuration includes purge valve 40, the instant invention can be incorporated on snorkels that do not include purge valve 40 by terminating the underwater end of conduit 20 at mouthpiece 42.

Purge valve 40 is, typically, a flexible diaphragm of a resilient material, for example silicon elastomer or the like, which is restrained in such a way that it can selectively flex under slight pressure to allow flow in one direction only. Reverse pressure forces the diaphragm to seal closed. Consequently, purge valve 40 will prevent the reverse flow of water from ambient into conduit 20.

Mouthpiece 42, above purge valve 40, branches from the side of conduit 20. Mouthpiece 42 is adapted to be held by the mouth of the diver and provides a flow path from conduit 20 to the interior of the mouth Conduit 20 is constructed of a rigid or semi-rigid material, for example, acrylic or vinyl plastic or the like. Conduit 20 is configured to approximately follow the curvature of the diver's head. The upper portion of conduit 20 smoothly curves to place upper end 20*a* approximately over the center of the head.

Providing a substantially smooth flow path that is free of abrupt changes in path direction facilitates respiration and purging. While not so limited, the curvature of conduit 20 may, for example, follow an elliptical path around the diver's head. Alternately, the upper portion of conduit 20 can be straight.

Figure 3:
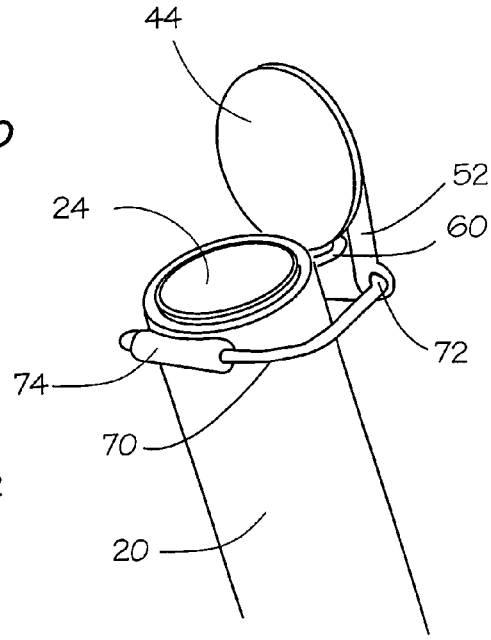
FIG. 3 is a close-up oblique view of the open valve of FIG. 1.

As best seen in FIG. 3, the upper portion of conduit 20 terminates at opening 24. Opening 24 is directly in-line with the conduit's longitudinal axis, thereby providing a substantially straight and unrestricted respiratory flow path to ambient.

Figure 2:
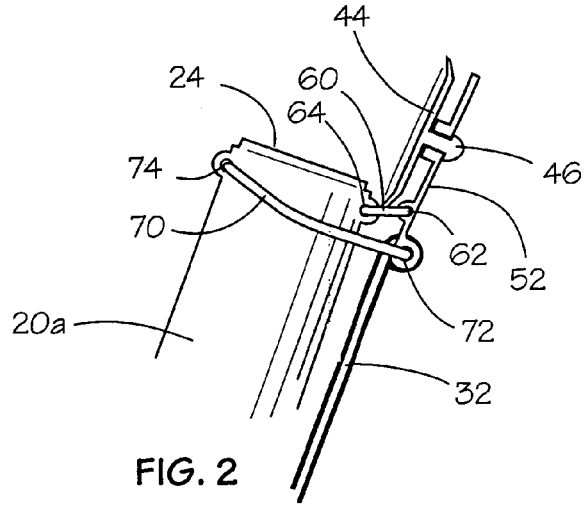
FIG. 2 is a close-up side view of the open valve of FIG. 1.
Figure 7:
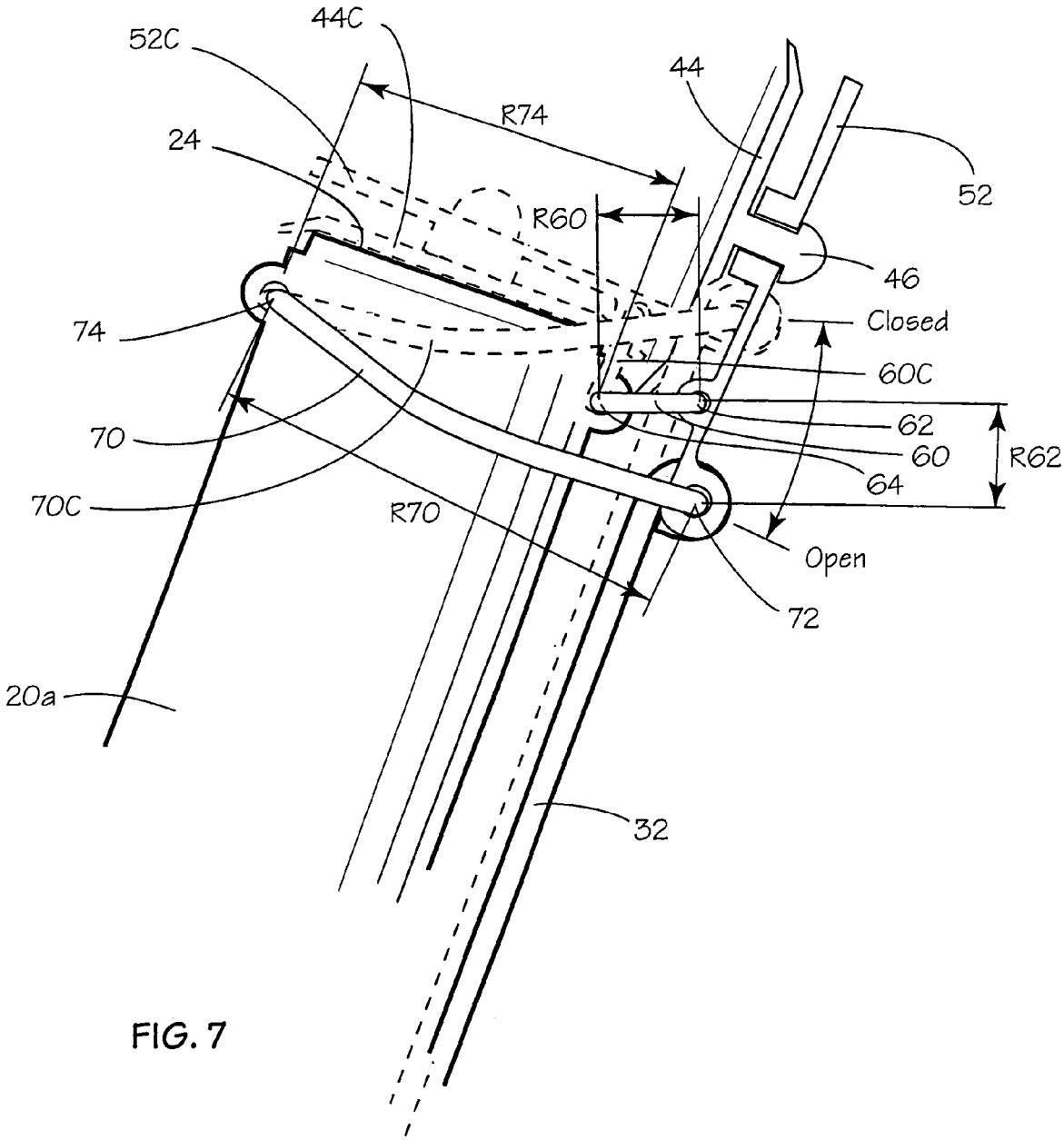
FIG. 7 is another close-up side view similar to FIG. 2.

Referring to FIGS. 2 and 7, valve assembly 50 is mounted on conduit 20 adjacent opening 24. Valve assembly 50 consists of a compound linkage that moves diaphragm 44 from an open position (shown by FIG. 2) to a closed position (shown by FIG. 5), and vice-versa. When diaphragm 44 is at the open position, it is located to the side of conduit 20, completely out of the respiratory flow path. When diaphragm 44 is at the closed position, it is located to provide a watertight covering of opening 24.

Diaphragm 44 is loosely mounted on arm 52 by tab 46. The movement of arm 52 is guided by the compound action of short link 60 and long link 70. One end of short link 60 is joined to arm 52 by pivot 62. The other end of short link 60 is joined to one side of snorkel opening 24 by pivot 64. Similarly, one end of long link 70 is joined to arm 52 by pivot 72; and the other end of long link 70 is joined to the opposite side of snorkel opening 24 by pivot 74.

The lengths of links 60 and 70; and the relative positions of pivots 62, 64, 72 and 74 are chosen to form a quadrilateral linkage assembly that moves diaphragm 44 from the open to the closed positions, and vice-versa. Referring to FIG. 7, link 60 is distance R60 long. Link 70 is distance R70 long. Pivots 62 and 72 are distance R62 apart. Pivots 64 and 74 are distance R74 apart. R60, R70, R62 and R74 form a four-sided polygon.

Figure 5:
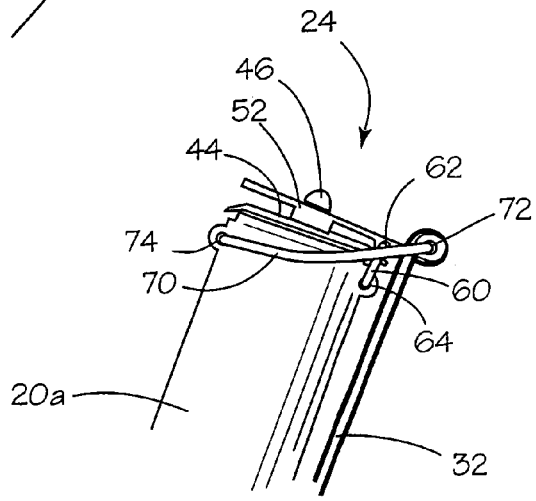
FIG. 5 is a close-up side view of the closed valve of FIG. 4.

The dimensions of R60, R70, R62 and R74; and the locations of pivots 62 and 72 on arm 52; and the locations of pivots 64 and 74 on conduit 20; are carefully chosen so that assembly 50 will either hold diaphragm 44 to the side of conduit 20 out of the respiratory flow path as shown by FIG. 2 (the "open" position), or place diaphragm 44 over and against opening 24 as shown by FIG. 5 (the "closed" position). Furthermore, the dimensions and locations are chosen so that valve assembly 50 is stable only when at either the fully open or completely closed positions.

Referring to FIG. 7, links 60 and 70, diaphragm 44, and arm 52, are shown in the open position as solid lines; and in the closed position as dashed lines identified 60C, 70C, 44C ad 52C respectively. The movement of link 70 between the open and closed positions is depicted by the double arrowed are identified "Open-Closed".

While not so limited, empirical studies have determined that R74 should be equivalent to the outside diameter of conduit 20. The ratio of R60, R70, and R62 to R74 should be approximately 0.3 to 1.4 to 0.3 to 1. In addition, links 60 and 70 should be nearly parallel when valve assembly 50 is at the open position (see FIG. 7).

Valve assembly 50 moves in response to the movement of float 30. The movement of float 30 is transmitted to valve assembly 50 by rod 32. One end of rod 32 is firmly joined to float 30. The other end of rod 32 is pivotally joined with pivot 72 of link 70 (best seen in FIG. 6).

Figure 4:
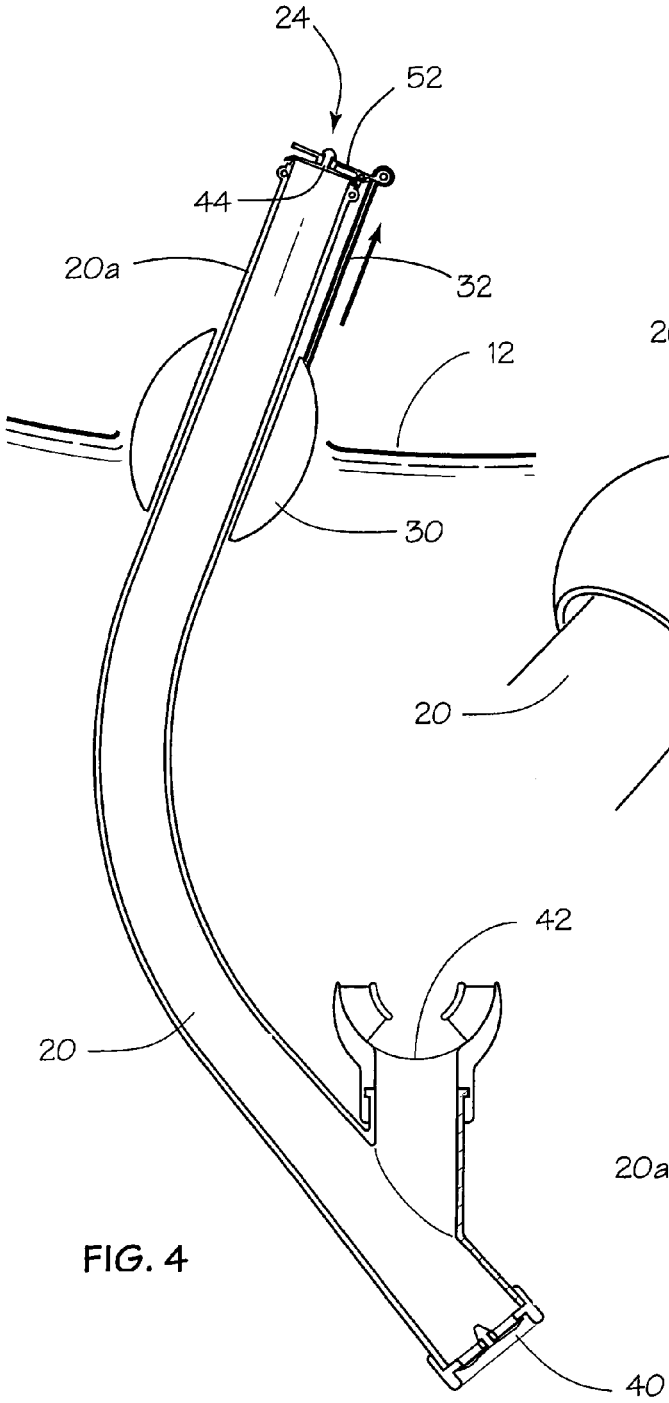
FIG. 4 is a longitudinal sectional side view of the snorkel of FIG. 1 shown with the valve closed.

When float 30 is not in the water, the weight of float 30 pulls rod 32 downward thereby pulling arm 52 to the open position. When float 30 is in the water, the resultant buoyant force pushes rod 32 upward thereby pushing arm 52 to the closed position. The upward pointing arrow in FIG. 4 depicts the direction of closing movement of float 30 and rod 32.

Diaphragm 44 is, typically, a flexible diaphragm of a resilient material, for example silicon elastomer or the like. Diaphragm 44 is loosely mounted on arm 52 by tab 46. The loose mounting enables diaphragm 44 to flex and tilt as needed to make a watertight seal against the periphery of opening 24.

Figure 6:
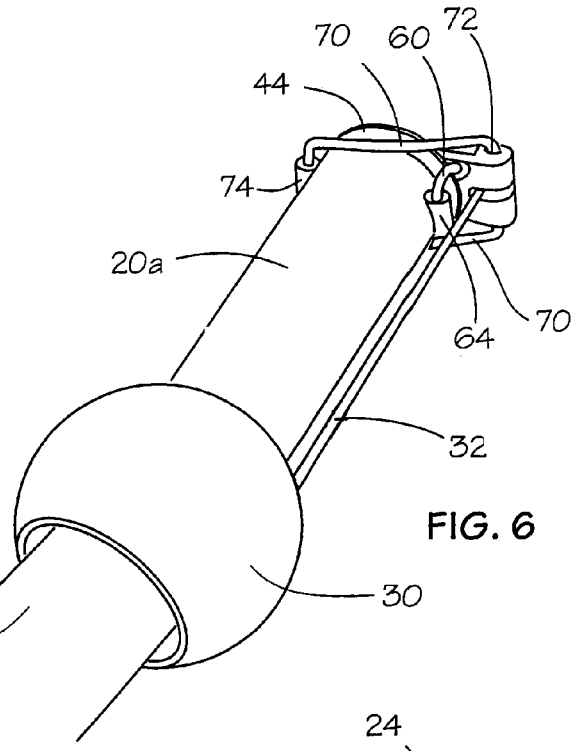
FIG. 6 is an upward-looking oblique view of the closed valve of FIG. 4.

Float 30 is typically a low-density material, for example closed-cellular ridged foam or the like. Alternately, float 30 can be hollow. As best seen in FIG. 6, float 30 loosely surrounds and is thereby guided by conduit 20. Although a spherical external surface is pictured, float 30 can be cylindrical, elliptical, or any other useful shape. By appropriately adjusting the length of rod 32, float 30 can be located anywhere along conduit 20 between valve 50 and mouthpiece 42. When float 30 is located relatively close to valve 50, the closing response of valve 50 is delayed until almost all of conduit 20 is underwater. When float 30 is located relatively close to mouthpiece 42, the closing response of valve 50 will be very sensitive to water movement up conduit 20. The ideal location of float 30 is a compromise so that valve 50 is fully closed by the time conduit 20 is completely underwater, but not so sensitive as to be inadvertently closing due to wave action or swimming movement.

Arm 52 is typically fabricated by molding a rigid material, for example polycarbonate plastic. Links 60 and 70 are typically fabricated by bending wire, for example, 316 stainless steel wire. Links 60 and 70 can also be fabricated by stamping and bending thin sheet metal stock, for example, 316 stainless steel sheet. Alternately, links 60 and 70 can be fabricated by molding a rigid material, for example polycarbonate plastic.

Referring to FIGS. 1 and 2, when float 30 is entirely out of the water, the weight of the float has pulled rod 32, and consequently pivot 72, downward. Conversely, referring to FIGS. 4 and 5, when water travels up snorkel 10 and starts to submerge float 30, for example, due to wave action or a deliberate diving action by the swimmer, buoyant force will overwhelm the weight of float 30 and the weight of valve assembly 50, causing pivot 72 to move upward, which causes arm 52 to drop diaphragm 44 over opening 24. Short link 60 serves to provide the sideways and dropping movement of arm 52 and, thereby, diaphragm 44. Advantageously, the volume of float 30 is chosen so that sufficient buoyant force is available to close valve 50. However, an overly large float 30 will be bulky and unwieldy. Consequently, the size of float 30 is a compromise that provides adequate buoyancy but not excess bulk.

When float 30 is partially or completely submerged, buoyant force will cause diaphragm 44 to cover opening 24, thereby preventing water from entering conduit 20. If opening 24 is closed while the swimmer is inhaling, inhalation flow will be blocked to prevent the undesirable entry of water into conduit 20. If opening 24 is closed while the swimmer is exhaling, the pressure of exhalation will flex diaphragm 44 outward thereby allowing the exhaled gases to continue to escape. Any subsequent inhalation will be blocked until float 30 is once again above the water.

If the swimmer removes mouthpiece 42 from the mouth while in the water, for example to talk, snorkel 10 will often be at least partially flooded when the swimmer returns mouthpiece 42 to the mouth for additional use. Similarly, if the swimmer enters the water without mouthpiece 42 already in the mouth, snorkel 10 will often be at least partially flooded when the swimmer first puts mouthpiece 42 in the mouth. In addition, saliva from the mouth can drain into conduit 20 and accumulate below mouthpiece 42.

Water and saliva in conduit 20 are purged by forcefully exhaling air into mouthpiece 42. Surface tension forms the exhaled air into a bubble that expands upward in conduit 20. As the leading surface of the bubble moves away from mouthpiece 42, the bulk of the water within conduit 20 is pushed ahead of the bubble and out opening 24. This purging action is facilitated by the instant invention because opening 24 is substantially in line with the longitudinal axis of conduit 20.

In the event that float 30 moves upward (due, for example, to wave action) during the purging exhalation, diaphragm 44 will close, but the expulsion of water will continue because the internal pressure will flex the diaphragm outward, away from opening 24, and allow the water inside conduit 20 to escape. Consequently, inventive snorkel 10 does not prevent a purging exhalation even when conduit upper end 20*a* is nearly or completely underwater.

When optional purge valve 40 is provided, a forceful exhalation will also expand downward, forcing fluid below mouthpiece 42 to flow to ambient through purge valve 40. The outflow of water will flex purge valve 40 outward. Consequently, a purging exhalation forces water within conduit 20 to be cleared both above and below mouthpiece 42.

The volume of the portion of conduit 20 between mouthpiece 42 and purge valve 40 is advantageously sized to hold, away from the respiratory flow path, saliva or any residual water that remains after a purging exhalation. Empirical studies have determined that a volume equivalent to ten percent (10%) of the snorkel's total internal volume can be sufficient for this purpose.

When a swimmer dives below the water surface and snorkel 10 is completely submerged, float 30 will have moved upward, thereby causing diaphragm 44 to cover opening 24. As the diver continues to swim below the water surface and looks around, the orientation of snorkel 10 will not necessarily remain upright. Head movements will change the orientation of snorkel 10 relative to the water surface. For example, snorkel 10 will be completely inverted relative to the water surface when the swimmer is looking directly upward.

When a swimmer first dives underwater, buoyancy can provide sufficient force to close valve assembly 50 when snorkel 10 is fully submerged, ambient pressure can also act to hold diaphragm 44 firmly against opening 24. Underwater, the pressure inside snorkel 10 can never be greater than ambient because excess pressure will be vented through the check valve action of diaphragm 44 or, when snorkel 10 is inverted, purge valve 40. The ambient pressure at the depth of diaphragm 44, or purge valve 40 when snorkel 10 is inverted, will determine the maximum pressure inside conduit 20. As the swimmer dives deeper, ambient pressure against the lungs will compress the lungs thereby maintaining the respiratory tract at or near ambient pressure. Although instinctively the swimmer will stop breathing when underwater, and may plug mouthpiece 42 with the tongue, the pressure of the respiratory tract will involuntarily bleed through mouthpiece 42 into conduit 20. However, unless the swimmer continuously exhales into snorkel 10 as the depth increases, the pressure inside snorkel 10 will be somewhat less than ambient. The slightly lower pressure inside conduit 20 with respect to ambient pressure is used by the instant invention to keep diaphragm 44 firmly sealed against opening 24, no matter what the orientation of snorkel 10.

Furthermore, when snorkel 10 is inverted, the buoyant force will be working to move float 30 away from the closed position, but the gravitational force and the differential pressure force across diaphragm 44 will be working to hold diaphragm 44 in the closed position. For diaphragm 44 to remain at the closed position even when snorkel 10 is inverted, the net pressure force against the diaphragm plus gravitational force must be greater than the buoyant force from float 30. The preferred configuration includes purge valve 40 because purge valve 40 provides the benefit of maintaining the pressure inside conduit 20 less than ambient when snorkel 10 is inverted underwater, thereby maximizing the pressure force holding diaphragm 44 closed.

Figure 8:
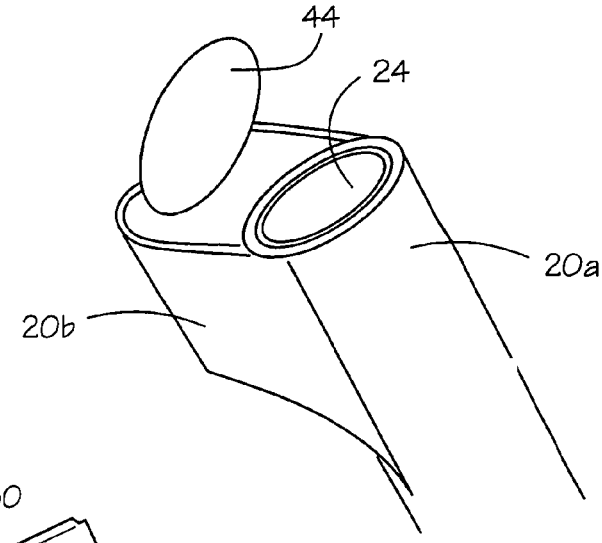
FIG. 8 is an oblique view showing an alternate configuration.

It is advantageous to cover valve assembly 50 in order to prevent external objects or material, for example seaweed, from snagging on or otherwise interfere with the function of linkages 60 and 70, arm 52, and diaphragm 44. Any such cover must be open at the top so that it will not interfere with respiratory or purging flow. Referring to FIG. 8, cover 20*b* is shown as an example of a means to protect the valve components and also streamline the top of conduit 20. Cover 20*b* is shown protruding from the side of conduit 20, but other configurations can be conceived that are appropriate, for example a ring that completely surrounds valve 50 and conduit end 20*a*, and possibly float 30.

Figure 9:
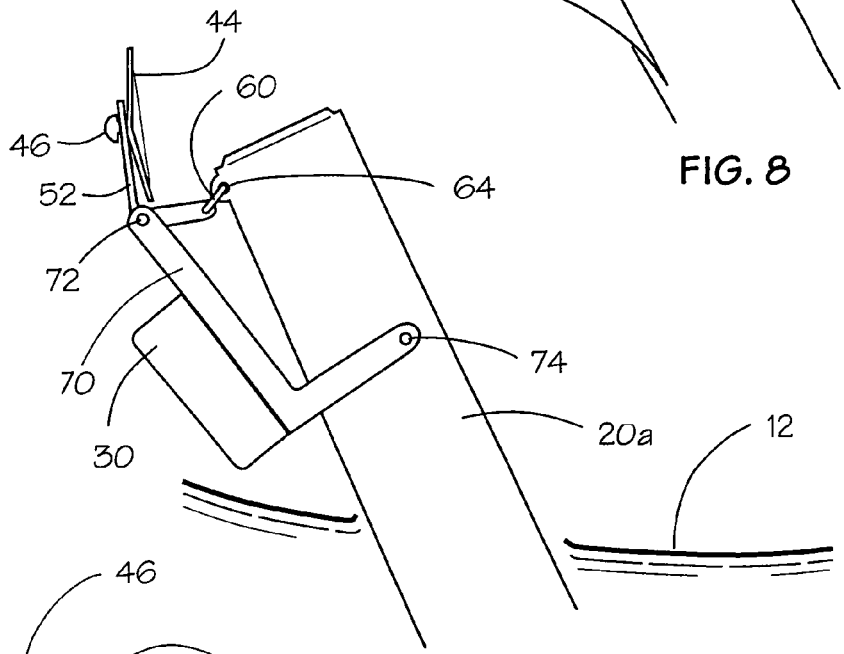
FIG. 9 is a close-up side view of another alternate configuration showing the valve open.
Figure 10:
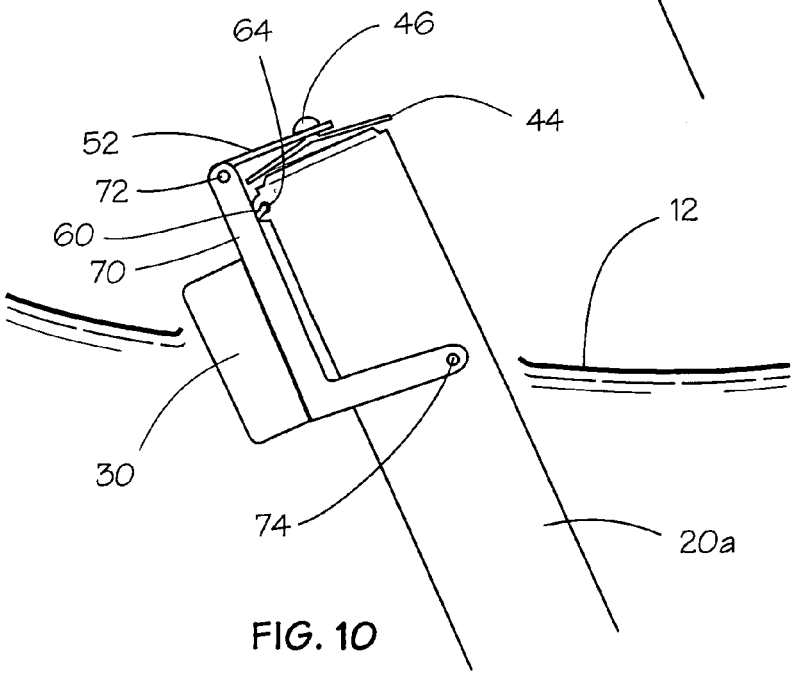
FIG. 10 is a close-up side view of the alternate configuration of FIG. 9 showing the valve closed.

FIGS. 9 and 10 show an alternate configuration, open and closed respectively, of the instant invention in which float 30 is directly attached to and is carried by link 70. To accommodate the placement of float 30 on link 70, pivot 74 must be located as shown in FIGS. 9 and 10. In addition, the diaphragm 44 is attached to an arm 52 that is pivotally connected to the conduit 20*a* via link 60. In the illustrated embodiment, the arm 52 includes a bend and the linkage 70 is attached to the bend of the arm 52 at a pivot 72. In many embodiments, a covering 20*b* such as that shown in FIG. 8 can be attached to the conduit to encase the float 30. As with the preferred configuration of FIG. 1, the dimensions of the four-sided polygon formed by the various links must be chosen so that diaphragm 44 moves completely out of the respiratory flow path when float 30 is above the water surface.

Other variations on the diameter, cross-section shape and radius of curvature of conduit 20; size and shape of float 30; size, shape and location of valve assembly 50 on conduit 20; size and shape of cover 20*b*; and various methods to adjust the mouthpiece location and orientation relative to the conduit, are contemplated.

It is understood that those skilled in the art may conceive of modification and/or changes to the invention described above. Any such modifications or changes that fall within the purview of the description are intended to be included therein as well. This description is intended to be illustrative and is not intended to be limiting. The scope of the invention is limited only by the scope of the claims appended hereto.

What is claimed is:

1. A snorkel device comprising:

a conduit having a first end and a second end;

a mouthpiece joined to the conduit second end;

an arm possessing a first end pivotally connected to the conduit and a second end connected to a diaphragm; and a float pivotally connected to the arm;

wherein the arm includes a bend; and wherein the float is pivotally attached at the bend in the arm.

2. The snorkel device of claim 1, wherein the pivotal connection between the arm and the conduit comprises a linkage that includes a first end pivotally connected to the conduit and a second end pivotally connected to the arm.

3. The snorkel device of claim 1, wherein:

the influence of gravity on the float causes the arm to occupy a first position when no portion of the float is submerged and the first end points skyward; and the diaphragm does not obstruct an opening in the first end of the snorkel device when the arm occupies the first position.

4. The snorkel device of claim 3, wherein:

the arm occupies a second position when at least a portion of the float is submerged and the first end of the conduit points skyward; and the diaphragm covers an opening in the first end of the snorkel device when the arm occupies the second position.

5. The snorkel device of claim 4, wherein the diaphragm is flexible.

6. The snorkel device of claim 5, wherein the diaphragm is constructed from silicon elastomer.

7. The snorkel device of claim 1, wherein the float is constructed from a rigid material and the float has a density less than that of water.

8. The snorkel device of claim 1, further comprising:

a protective covering attached to the side of the conduit that at least partially encases the float;

wherein the float is free to move inside the protective covering.

9. The snorkel device of claim 1, further comprising:

a protective covering attached to the side of the conduit that at least partially encases the arm;

wherein the arm is free to move inside the protective covering.

10. A snorkel device comprising:

a conduit having a first end and a second end;

a mouthpiece joined to the conduit second end;

an arm possessing a first end pivotally connected co the conduit and a second end connected to a diaphragm; and a float pivotally connected to the arm;

wherein the arm is pivotally connected in two separate locations to the conduit;

wherein the two pivotal connections have a common axis of rotation.

11. The snorkel device of claim 10, wherein:

the influence of gravity on the float causes the arm to occupy a first position when no portion of the float is submerged and the first end points skyward; and the diaphragm does not obstruct an opening in the first end of the snorkel device when the arm occupies the first position.

12. The snorkel device of claim 11, wherein:

the arm occupies a second position when at least a portion of the float is submerged and the first end of the conduit points skyward; and the diaphragm covers an opening in the first end of the snorkel device when the arm occupies the second position.

13. The snorkel device of claim 10, wherein the diaphragm is flexible.

14. The snorkel device of claim 13, wherein the diaphragm is constructed from silicon elastomer.

15. The snorkel device of claim 10, wherein the float is constructed from a rigid material and the float has a density less than that of water.

16. The snorkel device of claim 10, further comprising:

a protective covering attached to the side of the conduit that at least partially encases the float;

wherein the float is free to move inside the protective covering.

17. The snorkel device of claim 10, further comprising:

a protective covering attached to the side of the conduit that at least partially encases the arm;

wherein the arm is free to move inside the protective covering.

18. A snorkel device comprising:

a conduit having a first end and a second end;

a mouthpiece joined to the conduit second end;

an arm possessing a first end pivotally connected to the conduit and a second end connected to a diaphragm; and a float pivotally connected to the arm;

wherein the float is also pivotally attached via a linkage to the conduit.

19. The snorkel device of claim 18, wherein the linkage includes a first end pivotally connected to the conduit and a second end pivotally connected to the float.

20. The snorkel device of claim 18, wherein:

the influence of gravity on the float causes the arm to occupy a first position when no portion of the float is submerged and the first end points skyward; and the diaphragm does not obstruct an opening in the first end of the snorkel device when the arm occupies the first position.

21. The snorkel device of claim 20, wherein:

the arm occupies a second position when at least a portion of the float is submerged and the first end of the conduit points skyward; and the diaphragm covers an opening in the first end of the snorkel device when the arm occupies the second position.

22. The snorkel device of claim 18, wherein the diaphragm is flexible.

23. The snorkel device of claim 22, wherein the diaphragm is constructed from silicon elastomer.

24. The snorkel device of claim 18, wherein the float is constructed from a rigid material and the float has a density less than that of water.

25. The snorkel device of claim 18, further comprising:

a protective covering attached to the side of the conduit that at least partially encases the float;

wherein the float is free to move inside the protective covering.

26. The snorkel device of claim 18, further comprising:

a protective covering attached to the side of the conduit that at least partially encases the arm;

wherein the arm is free to move inside the protective covering.

* * * * *